US008490961B2

(12) United States Patent
Voorhees et al.

(10) Patent No.: US 8,490,961 B2
(45) Date of Patent: Jul. 23, 2013

(54) COLLATING SYSTEM

(75) Inventors: Tim Voorhees, East Bangor, PA (US); Ed Yeoman, Stratham, NH (US); Mike White, Nazareth, PA (US); Timothy Goszka, Emmaus, PA (US); Roger Bilodeau, St. James, NY (US)

(73) Assignee: Muller Martini Corp., Hauppauge, NY (US)

( * ) Notice: Subject to any disclaimer, the term of this patent is extended or adjusted under 35 U.S.C. 154(b) by 390 days.

(21) Appl. No.: 12/615,010

(22) Filed: Nov. 9, 2009

(65) Prior Publication Data

US 2010/0156019 A1 Jun. 24, 2010

Related U.S. Application Data

(60) Provisional application No. 61/112,508, filed on Nov. 7, 2008.

(51) Int. Cl.
*B65H 37/04* (2006.01)
*B65H 39/06* (2006.01)

(52) U.S. Cl.
USPC ..... 270/52.16; 270/1.01; 270/52.03; 270/52.14; 270/52.19; 270/52.2; 270/52.26; 270/52.29; 270/58.23

(58) Field of Classification Search
USPC ..... 270/1.02, 52.02, 52.03, 52.14, 52.19, 270/52.2, 52.21, 52.22, 52.26, 52.29, 58.23, 270/58.06
See application file for complete search history.

(56) References Cited

U.S. PATENT DOCUMENTS

| | | | | |
|---|---|---|---|---|
| 4,723,770 | A | 2/1988 | Seidel | |
| 5,660,382 | A * | 8/1997 | Meier | 270/52.16 |
| 6,257,566 | B1 * | 7/2001 | Dooley | 270/52.18 |
| 7,096,088 | B2 * | 8/2006 | Graushar et al. | 700/223 |
| 7,102,095 | B2 * | 9/2006 | Blohm | 209/584 |
| 7,325,375 | B2 * | 2/2008 | Graushar et al. | 53/397 |
| RE42,404 | E * | 5/2011 | Dooley | 270/52.18 |
| 2003/0183097 | A1 | 10/2003 | Pav | |
| 2004/0073330 | A1 | 4/2004 | Bader | |

* cited by examiner

*Primary Examiner* — Leslie A Nicholson, III
(74) *Attorney, Agent, or Firm* — Lucas & Mercanti, LLP; Peter J. Phillips

(57) ABSTRACT

A co-mailing system uses an insert machine to merge different mail streams into one stream in the sequence of a master mail list. By using an insert machine with vertically oriented pockets traveling on a moving conveyor, the speed of merging the mail streams is high and efficiency is obtained.

23 Claims, 4 Drawing Sheets

COLLATING SYSTEM

CROSS REFERENCE TO RELATED APPLICATIONS

This application claims priority on provisional application U.S. Ser. No. 61/112,508 filed Nov. 7, 2008, which is incorporated by reference herein.

FIELD OF THE INVENTION

This invention relates to collating printed products in accordance with an address sequence and more particularly combining mail streams, co-mailing, using an insert machine.

BACKGROUND OF THE INVENTION

With increased postal costs and rates, printers and publishers are looking for ways to mail printed products more cost effectively. Combining two or more titles into one mail stream, co-mailing, is one way to achieve postal savings. However, the combination of two or more mail streams in a production setting has proven complex and difficult.

Conventionally, two or more mail streams are combined using mail tables. Mail tables are horizontal surfaces on which one stream is carried while the other stream is placed on top in a horizontal manner so as to combine the two mail streams. Such horizontally oriented tables operate in a fairly slow manner. There is a need to increase the speed at which co-mailing operations are performed.

SUMMARY OF THE INVENTION

This invention provides a collating system which arranges product into a sequence based on addresses, with increased speed. Additionally, the invention increases the flexibility of the collating system in that it allows for the number of mail streams which are collated to be increased or decreased as the need arises, without modifying the machine.

This invention uses an insert machine of the type which is traditionally used in the newspaper industry to merge the mail streams. Insert machines have vertically oriented pockets that travel on a conveyor and a plurality of feeders which are positioned above the conveyor so as to vertically feed flat product from a hopper into the vertically oriented open pocket as it travels below the feeder such that the flat product is vertically adjacent other flat products. In the invention, each feeder is assigned a mail stream and the number of mail streams that are merged can vary by turning on and off the feeders. The speed of combining mail streams is greatly increased because the insert machine normally inserts 80,000 products per hour compared to horizontal mail tables which normally operate at about 20,000 products per hour.

Broadly, the present invention can be defined as a method comprising:

- providing a master list having a sequence of recipients;
- assembling printed products to form a first mail stream;
- feeding the printed products from the first mail stream into moving vertical pockets of an insert machine;
- providing a second mail stream of printed products to the insert machine; and
- feeding the printed products from the second mail stream into the moving vertical pockets to combine the first and the second mail streams in the sequence of the master list.

The assembling of the printed products is conducted by any conventional assembling machine such as a saddle stitching machine, with or without a trimmer; a perfect binder; a printing press; a roller storage device, flexiroller; a mail table; or other conventional devices. The merging of the printed products from the first and second mail streams is conducted using an insert machine which is either a straight line insert machine or a rotary insert machine.

It is preferred that prior to moving the first mail stream to the insert machine that printed address indicia are printed on the printed product of the first mail stream and the printed address indicia which are on the printed product of the first mail stream are read prior to feeding the printed product from the first mail stream into the moving vertical pockets. By printing address indicia on the printed product of the first mail stream and reading the address indicia, the insert machine can determine which pockets receive the printed product from the second mail stream and any subsequent mail streams. Additionally, if multiple mail streams are merged with the insert machine, one or more pockets either before or after the pocket holding the printed product of the first mail stream needs to be available for accepting printed product from the additional mail streams that are merged in with the first mail stream. By having additional empty pockets on either side of the pocket holding the printed product of the first mail stream, flexibility is provided to allow for unlimited numbers of printed products from various mail streams to be adjacent to the printed product of the first mail stream and, thus, to be co-mailed.

Preferably, each of the feeders in the insert machine is equipped with a printer so as to print address indicia on each of the printed products from each of the mail streams such that each of the printed products for each of the mail streams have address indicia thereon. Additionally, the printer can print images or text onto the printed product so as to add additional information onto the printed product.

A shuttle can be used to move the first mail stream from the assembling machine to the insert machine.

A removing machine is used to remove the collated printed products from the moving pockets and to transport the printed products from the pocket to a further processing machine. Suitably an overhead gripper is used to remove the collated printed product to a stacker/bundler, polybagger, strapper, paperwrapper, palletizer, shrinkwrap tunnel or other conventional packaging machine.

Preferably, the collating system of the present invention employs a first controller which is provided with a master list having a sequence of recipients to control the assembly of the printed product on the assembling machine and to print address indicia on the printed product of the first mail stream. A second controller having a second master list with the sequence of recipients thereon is used for controlling the merge of the mail streams on the insert machine. The second controller has a lookup table so that when the insert machine reads the address indicia from the printed product of the first mail stream, that address is identified in the second controller which then looks up, in the second master list, which additional printed products from the subsequent mail streams are to be merged with the printed product from the first mail stream.

Preferably, the feeder of the printed product from the first mail stream is preferably the first feeder of the insert machine and this first feeder has an optical reading or other similar mechanism for detecting the address indicia on the printed product from the first mail stream and to notifying the second controller of the address indicia on the printed product of the first mail stream. This allows the second controller to control the downstream feeders of the insert machine so as to insert printed product from the second mail stream and any subsequent mail streams into the open pocket or around the open pocket so as to merge the mail streams into the sequence of the recipients.

These and other aspects of the present invention will be more readily understood by reference to one or more of the following drawings which are presented for purposes of illustration.

DETAILED DESCRIPTION OF THE DRAWINGS

Figure 1:
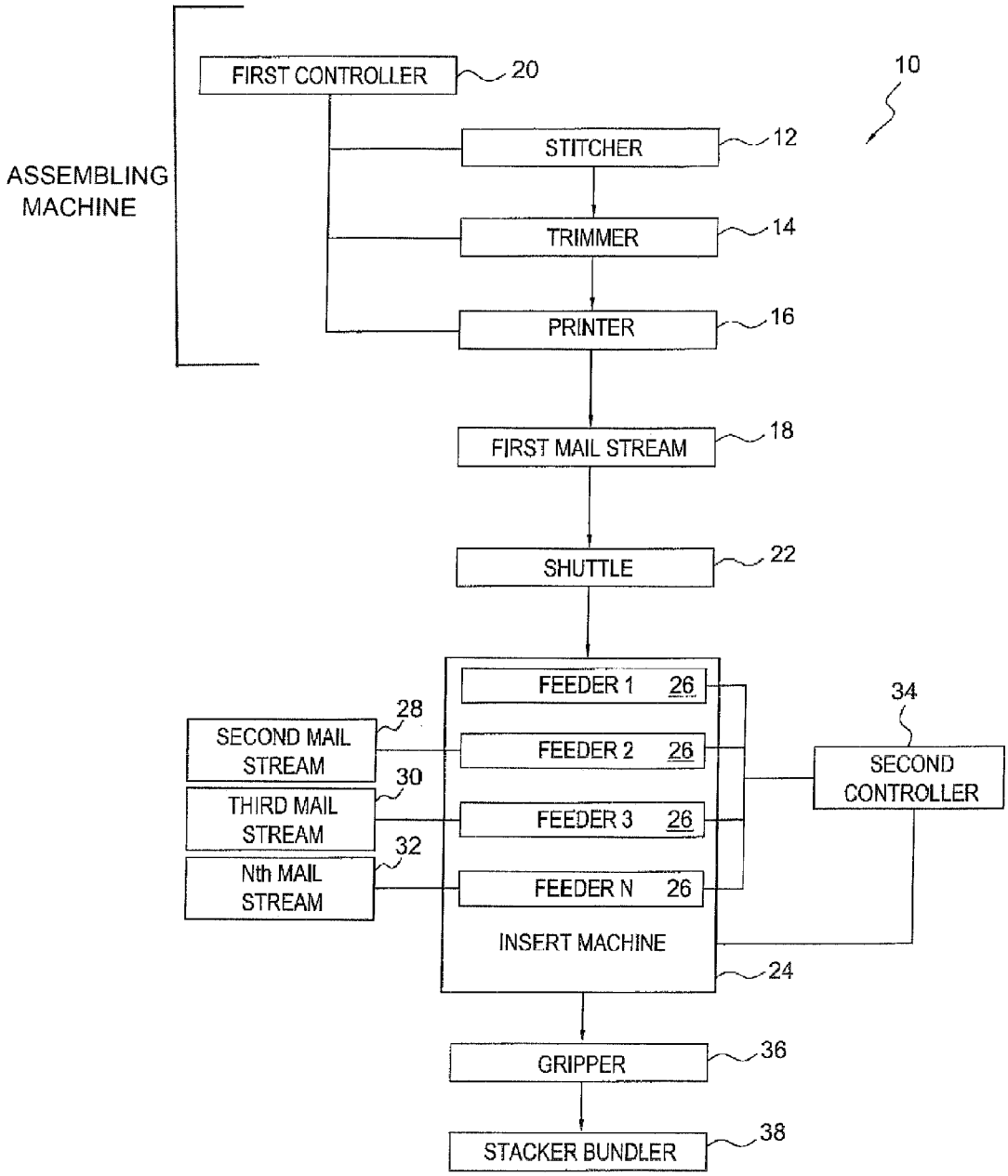
FIG. 1 is a schematic view of the co-mailing system of the present invention.

FIG. 1 illustrates co-mailing system 10 with stitcher 12 to form a printed product which transfers the printed product to trimmer 14 which produces the final printed product. The printed product from trimmer 14 is passed to printer 16 where address indicia are printed on the product. This forms first mail stream 18. The sequence of the printed product into a first mail stream by stitcher 12, trimmer 14 and printer 16 are controlled by first controller 20.

First mail stream 18 is then transferred to shuttle 22 which in turn transfers the first mail stream to insert machine 24. First mail stream 18 is delivered by shuttle 22 to the first feeder 26 of insert machine 24. Second mail stream 28 is provided to a second feeder 26 of insert machine 24. Likewise, third mail stream 30 is provided to a third feeder 26 of insert machine 24 and additional mail streams 32 are provided to additional feeders 26 of insert machine 24 to allow for a plurality of mail streams to be merged using insert machine 24.

The merging of the mail streams on insert machine 24 is controlled by second controller 34. Second controller 34 has a second master list of the sequence of recipients. First feeder 26 of insert machine 24 has an optical reading capability so as to read the printed indicia on the printed product from first mail stream 18 and to provide second controller 34 with the address on the printed product from first mail stream 18. In this way, second controller 34 can command the downstream feeders 26 as to which pockets the second and subsequent mail streams should be fed into. It also allows second controller 34 to know whether more than one pocket is needed for an individual recipient, and thereby provide for additional pockets either before or after the pocket containing the printed product from the first mail stream so as to bring together all the printed product for one recipient.

The printed products in the pockets of insert machine 24 are removed at the end of the insert machine by gripper 36. Gripper 36 then transfers the printed product to stacker/bundler 38.

Although a second controller 34 has been shown, and in some cases preferred, a single controller may, in some cases, be preferred. In some cases, the first and second controllers may be entirely independent, both in the machine functions they respectively control, as well as not communicating with each other. In some cases, some partial or total overlap in machine functions, and perhaps redundancy, may be preferred. In some cases, it may be preferred to have the two controllers communicate or share a common time base. In some cases, a main, third, controller could control the first and second controllers. In some cases, one controller could be a master, and the other, a slave.

The insert machine 24 can add inserts that are personalized beyond mere addressing, such as containing a personalized message for the recipient based on the recipient's prior purchase history or other personal information. The mail streams could be magazines, catalogs, newspapers, advertising inserts, or the like. One or more of the mail streams and feeders can incorporate a printer, such as an ink jet printer, for printing personalized indicia in real time.

One or more of the feeders can be a redundant or back-up feeder in case of a missing piece in the mail stream for repair of the product. One or more of the mail streams could be specific or personalized, and one or more could be generic, without specific or personalized indicia, such as a mass advertising insert.

Figure 2:
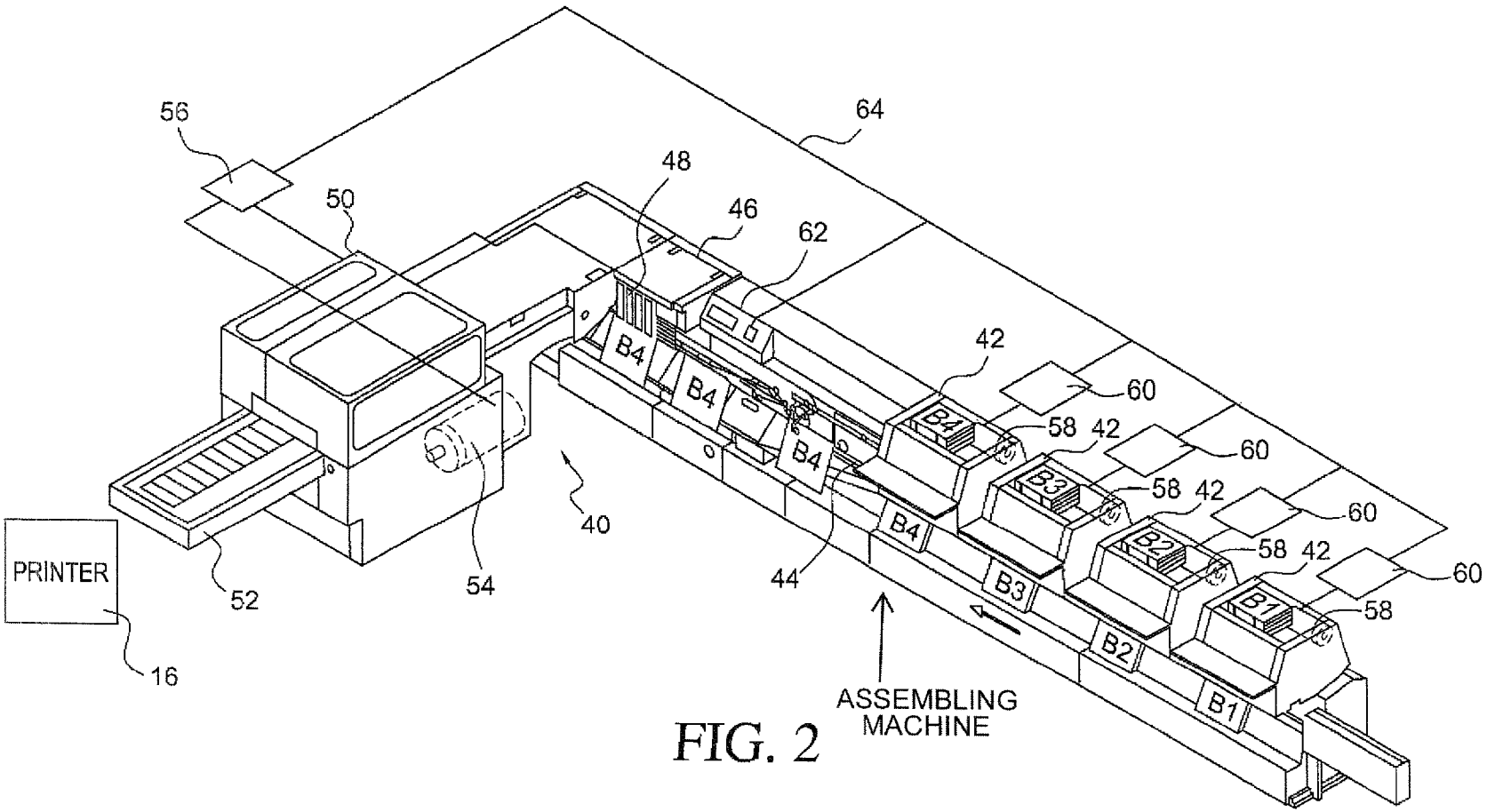
FIG. 2 illustrates the stitcher/trimmer and printer of the first half of the co-mailing system of the present invention.

Turning to FIG. 2, FIG. 2 is a detail illustration of the first half of the co-mailing apparatus and method. Saddle stitcher 40 has folded sheet feeders 42, each of which places a single folded sheet on assembly chain 44. Assembly chain 44 gathers the individual folded sheets labeled B1, B2, B3, and B4 and transports them to stitcher station 46. Stitcher heads 48 are arranged at stitcher station 22 to stitch folded sheets B1-B4 which align one on top of the other. From stitcher station 46 the stitched product is fed to trimmer 50 where the edges of the stitched folded sheet are cut to make a neat printed product. From trimmer 50, the finished printed product, such as a magazine, is fed to delivery station 52 which in turn passes the printed product to printer 16 which prints address indicia on the outside of the printed product.

The drive system for stitcher 40 includes a motor 54 and a controller 56. Motor 54 drives assembly chain 44, stitcher station 46, and trimmer 50. Folded sheet feeders 42 have individual secondary units which include electric motors 58 and individual controllers 60. Controllers 56 and 60 are connected by bus 64. Controller 56 controls trimmer 50 as well as motor 54 and printer 16. First controller 20 is made up of controller 56 and controller 60.

Saddle stitcher 40 and trimmer 50 are operated in conventional manner and are conventional pieces of equipment. Printer 16 can be any conventional printer which is capable of printing address indicia on printed product.

Figure 3:
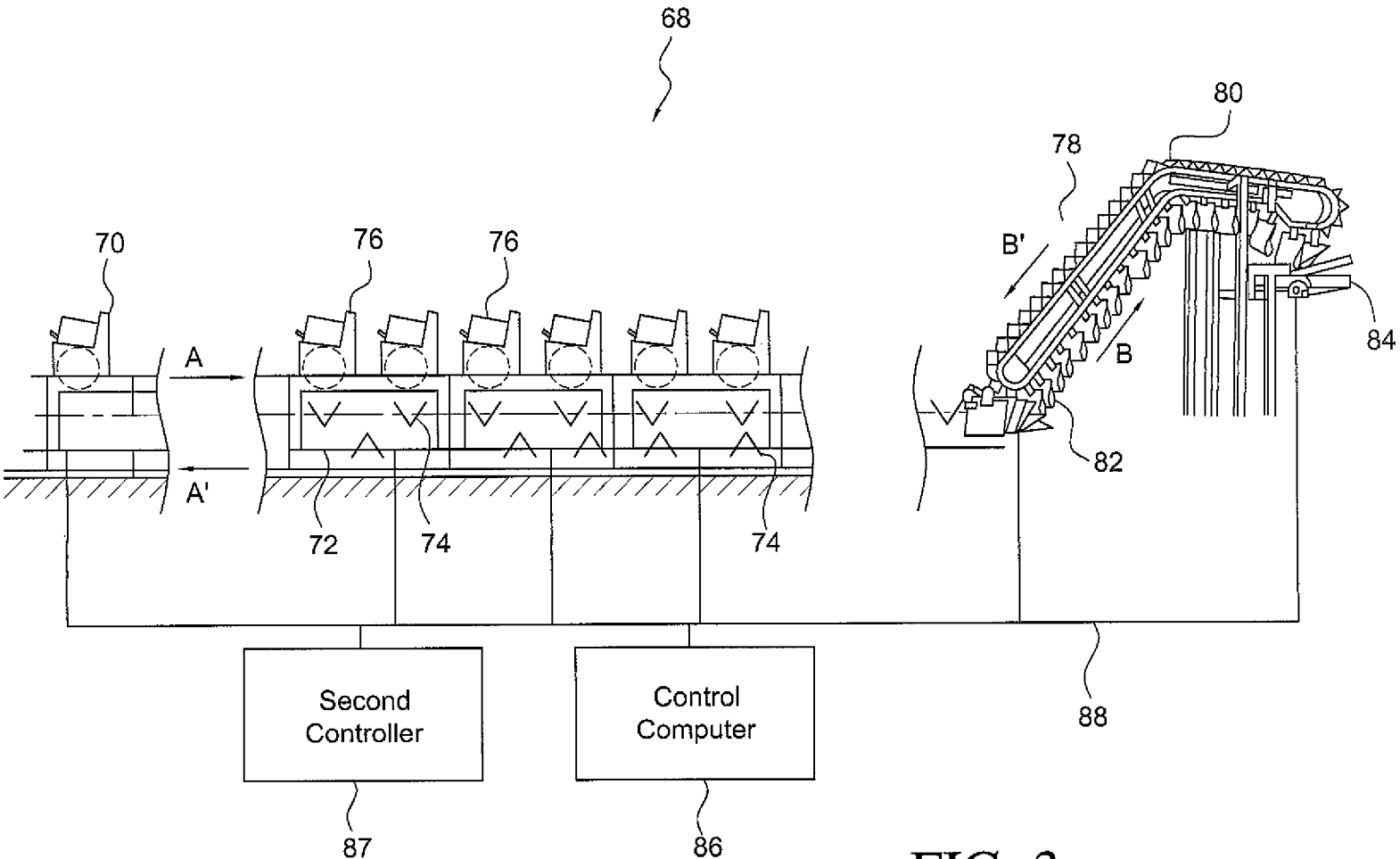
FIG. 3 illustrates the second half of the co-mailing system of the present invention with the insert machine, gripper and stacker.

FIG. 3 illustrates insert machine 68. Insert machine 68 has a first mail stream feeder 70 positioned at the upstream side of conveyor 72. A plurality of pockets 74 are mounted on conveyor 72 and travel with conveyor 72. A plurality of second and subsequent printed product feeders 76 are mounted above conveyor 72 for combining the mail streams and inserting printed product from subsequent mail streams into the open pocket 74. Conveyor 72 travels in the direction marked by arrow A and returns in the direction marked by arrow A'. Pockets 74 on the bottom of conveyor 72 are illustrated in an open position. Each pocket 72 moves past pocket pick up unit Gripper unit 78. Gripper unit 78 is made up of chain 80 and grippers 82. Grippers 82 are attached to chain 80 and chain 80 travels in direction B with printed products which have been removed from open pockets 74. Gripper 82 deposits the printed product on stacker/bundler 84.

Each one of the individual elements, feeder 70, feeder 76, conveyor 72, product pick up unit 78 and stacker/bundler 84 employ individual motors and a network controller which controls the operation. As shown in FIG. 3, control computer 86 communicates with and controls each one of the individual elements by bus 88.

The control computer 86 and method for controlling the same is taught in U.S. Pat. No. 6,907,314, the contents of which are incorporated herein by reference. A second control computer 87 is used to control the sequencing of the second and subsequent mail streams. Computer 87 has the second master list.

Figure 4:
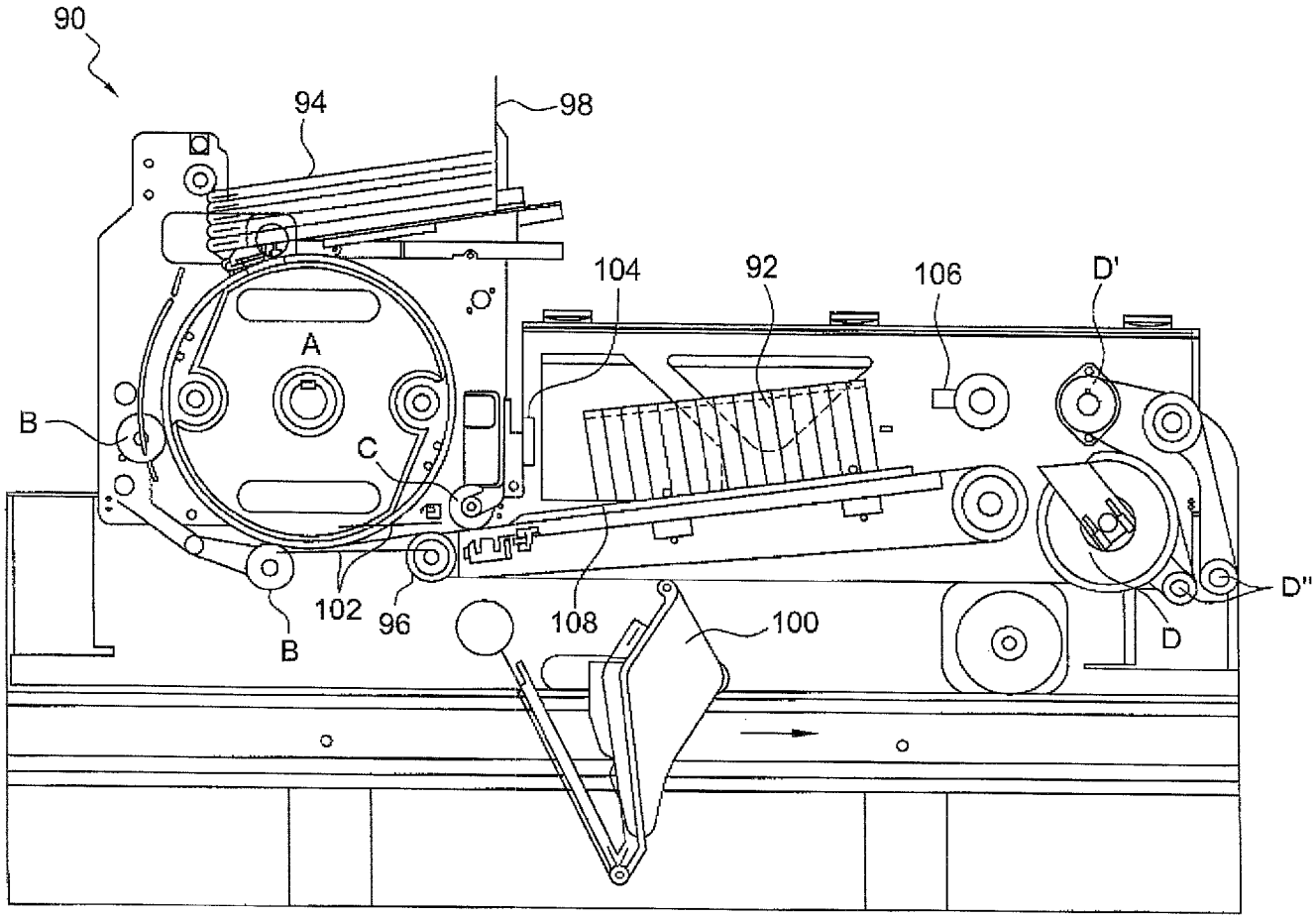
FIG. 4 illustrates the preferred insert machine with printer capabilities.

FIG. 4 illustrates a preferred embodiment for feeder 90 used on insert machine 68. Feeder 90 can be used for feeders 70 and/or 76 of FIG. 3.

Feeder 90 has insert tray 92 on which printed product 94 of a second or subsequent mail stream is positioned. Printed product 94 is fed from tray 92 via drum A and rollers B which, in turn, pass printed product 94 to transport mechanism 96 and printer 98. Printer 98 prints on to printed product 94 to place address indicia on printed product 94. Transport mechanism 96 moves printed product 94 through printer 98 and conveys printed product 94 to moving open pocket 100.

Suitably the speed of printed product 94 on drum A and rollers B is about twice the speed of the printed product conveyed by transport 96 through printer 98.

As printed product 94 is transported around drum A it comes into contact with follower rollers B. As printed product 94 leaves the second follower roller B, assisted by top and bottom guides 102, it comes into contact with slow down roller C. Slow down roller C slows down the speed of printed product 94 about half the speed on drum A and rollers B. Photoelectric queuing eye 104 detects the leading edge of printed product 94 and the transport speed of printed product 94 is measured by encoder 106 as it is conveyed by transport 96 with the assistance of vacuum transport mechanism 108. Printer 98 is suitably an inkjet printer that comprises a number of heads that are suitable for printing address indicia on printed product 94. Pick up rollers D, and the belt driven by rollers D' and D" accelerate the printed product 94 to about twice the speed of which it was in printer 98 so as to catch up with the speed of moving pocket 100 and deposits and inserts printed product 94 into moving pocket 100.

Feeder 90 is taught in U.S. Pat. No. 6,893,016, the contents of which are incorporated herein by reference.

It will be appreciated that feeder 70 can also be designed in the same manner as feeder 90 such that printed indicia first added to printed product 94 by feeder 70. In this embodiment, a first mail stream without printed indicia thereon is loaded into feeder 70 which is the first feeder in the stream of insert machine 68. In this embodiment, computer controller 87 has the second master list of recipients thereon. This embodiment also allows for complete separation of the insert machine and the stitcher/trimmer so the insert machine 68 can accommodate multiple stitcher/trimmers recognizing the fact that insert machine 68 operates at higher speeds than the stitcher/trimmer machines.

Bundler/stacker 84 is operated in a conventional manner to form bundles which are suitable for handling and shipping to the post office for mailing.

Additionally, a reject chute can be positioned along chain 80 of gripping unit 78 so that if the printed product contained in gripper 82 has been built incorrectly, the gripper can release its contents into the reject chute and a repair of the sequenced product can be done by hand.

Typically, the open pocket can accommodate a limited number of printed products from different mail streams. If more than a pocket's worth of printed products from different mail steams is destined for any single address, additional pockets can be provided before or after the one pocket.

Additionally, it will be understood that although a stitcher/trimmer is shown in the drawings, other assembling machines can be used to assemble the first mail stream.

Also, it will be understood that although a gripper and bundler/stacker are shown in the drawings, other removing and packaging machines can be used at the end of the insert machine to perform final processing on the collated product.

It will be understood that the claims are intended to cover all changes and modifications that the preferred embodiments of the invention herein chosen for purposes of illustration which do not constitute a departure from the spirit and scope of the present invention.

REFERENCE CHARACTERS

10 Co-mailing system
12 Sticher
14 Trimmer
16 Printer
18 First mail stream
20 First controller
22 Shuttle
24 Insert machine
26 Feeder
28 Second mail stream
30 Third mail stream
32 Nth mail stream
34 Second controller
36 Gripper
38 Stacker/Bundler
40 Saddle stitcher
42 Folded sheet feeders
44 Chain
46 Stitching station
48 Stitching heads
50 Trimmer
52 Delivery station
54 Electric motor
58 Motor
60 Folded sheet feeder controllers
62 Central operator station
64 Field bus
68 Insert machine
70 First mail stream feeder
72 Conveyor
74 Pocket
76 Insert feeder
78 Gripper unit
80 Chain
82 Gripper
84 Stacker/Bundler
86 Control computer
87 Second computer
88 Bus
90 Feeder
92 Tray
94 Printed product
96 Transport mechanism
98 Printer
100 Pocket
102 Guides
104 Queuing eye
106 Encoder
108 Vacuum transport

What is claimed is:

1. A method comprising:

providing a master mail list having a sequence of mail recipients;

assembling printed products to form a first mail stream, wherein assembling is conducted by placing a single folded sheet each by folded sheet feeders on an assembly chain, by gathering the individual folded sheets on top of another and transporting them to a stitcher station, by stitching said gathered folded sheets to form a printed product, by transferring said printed product to a trimmer for forming a trimmed product, by passing said trimmed product to a printer and printing address indicia on the product for forming the first mail stream;

feeding the printed products from the first mail stream into moving vertical pockets of an insert machine;

providing a second mail stream of printed products to the insert machine; and feeding the printed products from the second mail stream into the moving vertical pockets to combine the first and second mail streams in the sequence of the master list.

2. The method of claim 1, further comprising:

printing address indicia on the printed products of at least one of the first and the second mail stream.

3. The method of claim 1, wherein the first mail stream is assembled using an assembling machine.

4. The method of claim 3, wherein the insert machine is one of a straight line insert machine and a rotary insert machine.

5. The method of claim 1, wherein a shuttle transfers the first mail stream from the assembling machine to the insert machine.

6. The method of claim 1, wherein the insert machine has a first feeder for feeding the printed products from the first mail stream into the moving vertical pockets and a second feeder for feeding the printed products of the second mail stream into the moving vertical pockets.

7. The method of claim 2, wherein at least one of the first feeder and the second feeder further comprises a printer for printing address indicia on the printed products before feeding the printed products into the moving vertical pocket.

8. The method of claim 1, wherein the printed products from the second mail stream are fed to moving vertical pockets that contain the printed products from the first mail stream so as to combine printed product from the first and second mail streams in the same pocket.

9. The method of claim 1, wherein the printed product from the second mail stream is fed to an empty moving vertical pocket that is adjacent and subsequent to the pocket containing printing product from the first mail stream.

10. The method of claim 1, further comprising:

providing a third mail stream of printed product to the insert machine; and feeding the printed products from the third mail stream to the moving vertical pocket to combine the first, second, and third mail streams in the sequence of the master list.

11. The method of claim 10, wherein the third mail stream is provided to the insert machine downstream of the second mail stream.

12. The method of claim 1, further comprising:

packaging the combined mail streams.

13. The method of claim 1, wherein a first controller controls the assembly of the first mail stream; and a second controller controls merging of mail streams on the insert machine.

14. A method comprising:

providing a master mail list having a sequence of mail recipients;

assembling printed products to form a first mail stream using an assembling machine, wherein assembling is conducted by placing a single folded sheet each by folded sheet feeders on an assembly chain, by gathering the individual folded sheets on top of another and transporting them to a stitcher station, by stitching said gathered folded sheets to form a printed product, by transferring said printed product to a trimmer for forming a trimmed product, by passing said trimmed product to a printer and printing address indicia on the product for forming the first mail stream;

transferring the first mail stream to a shuttle and delivering the first mail stream by the shuttle to a first feeder of an insert machine;

feeding the printed products from the first mail stream into moving vertical pockets of the insert machine using the first feeder;

providing a second mail stream of printed products to a second feeder the insert machine; and feeding the printed products from the second mail stream into the moving vertical pockets using the second feeder to combine the first and second mail streams in the sequence of the master list.

15. The method of claim 14, further comprising:

printing address indicia on the printed products of at least one of the first and the second mail stream.

16. The method of claim 14, wherein the insert machine is one of a straight line insert machine and a rotary insert machine.

17. The method of claim 14, wherein at least one of the first feeder and the second feeder further comprises a printer for printing address indicia on the printed products before feeding the printed products into the moving vertical pocket.

18. The method of claim 14, wherein the printed products from the second mail stream are fed to moving vertical pockets that contain the printed products from the first mail stream so as to combine printed product from the first and second mail streams in the same pocket.

19. The method of claim 14, wherein the printed product from the second mail stream is fed to an empty moving vertical pocket that is adjacent and subsequent to the pocket containing printing product from the first mail stream.

20. The method of claim 14, further comprising:

providing a third mail stream of printed product to the insert machine; and feeding the printed products from the third mail stream to the moving vertical pocket to combine the first, second, and third mail streams in the sequence of the master list.

21. The method of claim 20, wherein the third mail stream is provided to the insert machine downstream of the second mail stream.

22. The method of claim 14, further comprising:

packaging the combined mail streams.

23. The method of claim 14, wherein a first controller controls the assembly of the first mail stream; and a second controller controls merging of mail streams on the insert machine.

* * * * *